US005344290A

United States Patent [19]

Benckert

[11] Patent Number: 5,344,290

[45] Date of Patent: Sep. 6, 1994

[54] METHOD AND DEVICE FOR CONTROLLING A DOUBLE-CYLINDER THICK MATTER PUMP

[75] Inventor: Hartmut Benckert, Leinfelden-Echterdingen, Fed. Rep. of Germany

[73] Assignee: Putzmeister-Werk Maschinenfabrik GmbH, Aichtal, Fed. Rep. of Germany

[21] Appl. No.: 690,915

[22] PCT Filed: Jul. 11, 1989

[86] PCT No.: PCT/EP89/00805

§ 371 Date: May 28, 1991

§ 102(e) Date: May 28, 1991

[87] PCT Pub. No.: WO90/06444

PCT Pub. Date: Jun. 14, 1990

[30] Foreign Application Priority Data

Dec. 5, 1988 [DE] Fed. Rep. of Germany .... 3840892.9

[51] Int. Cl.[5] ..... F04B 7/02

[52] U.S. Cl. ..... 417/342; 417/344; 417/345

[58] Field of Search ..... 417/342, 347, 344, 345, 417/339

[56] References Cited

U.S. PATENT DOCUMENTS 3,327,641 6/1967 Klosterman ..... 417/342 X
4,036,564 7/1977 Richards ..... 417/344

FOREIGN PATENT DOCUMENTS 2441831 3/1976 Fed. Rep. of Germany .
3243576A1 5/1984 Fed. Rep. of Germany .
3346820A1 7/1985 Fed. Rep. of Germany .
2040855 1/1971 France .
2273988 1/1976 France .
206683 11/1984 Japan ..... 417/900

*Primary Examiner*—Richard E. Gluck
*Attorney, Agent, or Firm*—Kenyon & Kenyon

[57] ABSTRACT

A method and device for controlling a thick matter pump having two feed cylinders, each coupled to a material feed tank and including a drive piston for pumping thick matter through the respective feed cylinder. Each drive piston is driven within a respective drive cylinder coupled to a hydraulic reversing pump, which drives each drive piston through a compression stroke by pumping pressurized fluid to the respective drive cylinder. A hydraulically operable tube switch is alternately coupled to the feed cylinders to receive the thick matter being pumped, and is coupled to a delivery pipe to direct the flow of thick matter from each feed cylinder into the delivery pipe. Hydraulic tube-switch cylinders actuate the tube switch and are coupled between the reversing pump and the feed cylinders for receiving pressurized fluid flowing between the reversing pump and the drive cylinders to decouple the tube switch from one feed cylinder and couple the tube switch to the other. The tube-switch cylinders actuate the tube switch upon the drive piston of the respective feed cylinder reaching the end of its compression stroke. The direction of pressurized fluid flow from the reversing pump is maintained upon actuating the tube switch to maintain the respective drive piston at the end of its compression stroke.

25 Claims, 2 Drawing Sheets

METHOD AND DEVICE FOR CONTROLLING A DOUBLE-CYLINDER THICK MATTER PUMP

BACKGROUND INFORMATION

The invention relates to a method and a device for controlling a thick matter pump with two feed cylinders which open through front-side openings into a material feed tank and which can be operated in a push-pull manner by means of at least one hydraulic reversing pump and by hydraulic driving cylinders controlled by the reversing pump, with a hydraulically operable tube switch configured inside the material feed tank which is suitable for connection on the intake side alternately to each of the openings of the feed cylinder and which releases the opening of the other feed cylinder, and is suitable for connection on the output side to a delivery pipe, whereby at the end of each feed-cylinder compression stroke, a tube-switch reversing operation is initiated and during the reversing operation the delivery of thick matter is interrupted.

A method for controlling a double-cylinder thick matter pump of this type is known (German Published Patent Application 32 53 576), wherein both the driving cylinders of the feed cylinder as well as the hydraulic actuating elements of the tube switch are pressurized directly by the pressurized oil delivered by the hydraulic reversing pump. Therein, however, 2/2 diverter seated valves are installed in the lines of the main feed cycle leading to the driving cylinders. These 2/2 diverter seated valves, for their part, are controllable by a braking valve. At the end of each compression stroke, an electric end-position signal immediately initiates the reversing action for the reversing pump. To prevent the thick matter material, which had been drawn in previously, from being fed back to the material feed tank, at the moment the reversing pump is switched over, the braking valve is reversed with the result that the 2/2 diverter seated valves are brought into their closed position, so that the pressurized media cannot flow from the reversing pump into the lines leading to the driving cylinders. At the same time, a sufficient pressure builds up in the specific high-pressure-media line leading to the actuating element to switch through the hydraulic actuating elements of the tube switch by means of a reversing valve. The switching of the reversing valve is delayed by means of a low-pass filter until the tube switch is switched over. After that, the 2/2 diverter seated valves are again opened for both flow-through directions. It can happen, however, primarily when thick matter with coarse components or when hardened thick matter, such as concrete, is conveyed, that the tube switch jams in the course of the switch-over operation and therefore does not switch through completely. Since the seated valves configured in the main circuit open automatically after the expiration of the delay time set at the low-pass filter, the result is that the material drawn in previously by a feed cylinder is fed back unintentionally to the material feed tank. When this backlash repeats itself due to permanent jams, rapid wear and tear or even destruction can result in the tube-switch area. Furthermore, in the case of the known circuit configuration, it has proven disadvantageous that seated valves, whose size must be adapted to the main oil flow, are configured in the main circuit leading from the reversing pump to the driving cylinders. Therefore, it is not possible to increase the output volume by switching in additional, parallel-connected reversing pumps without simultaneously exchanging the diverter seated valves in the main circuit, if these had not been oversized from the start.

Starting from here, the object of the invention is to develop a method and a device for controlling a thick matter pump of the type indicated at the outset, with which a hydraulic sequencing control of the driving cylinders and of the tube switch is possible without having to configure any valves or fittings in the main oil circuit.

SUMMARY OF THE INVENTION

With the procedure according to the invention, wherein during the tube-switch reversing operation the direction of delivery of the reversing pump is retained while a free supply of pressurized oil to the driving cylinders is maintained, and the direction of delivery of the reversing pump is reversed only at the end of the tube-switch reversing operation, the delivery operation is interrupted should the tube switch, for instance as the result of jamming, not completely switch through. With the measures according to the invention, it is possible for the driving cylinders and the tube-switch reversing elements to work in a one-way flow system and, nevertheless, for the driving cylinders to be charged in the free flow with pressurized oil. This means that to switch over the tube switch, pressurized oil is tapped off directly from a main circuit, which is free of fittings and valves and leads from the reversing pump to the driving cylinders. During the tube-switch reversing operation, the pistons of the driving cylinders are thereby retained at end-stop positions under the effect of the pressure produced by the reversing pump in the main circuit, until the tube-switch reversing operation is complete.

Advantageously, after each switch-over operation, a preferably hydraulic or electric end-position signal is tapped off at the tube switch or at its hydraulic actuating elements to initiate the reversal operation. At the same time, the supply of pressurized oil to the tube-switch actuating elements is interrupted or reversed while compensating for the reversal of oil flow in the main circuit. Following this, during the delivery of thick matter, the hydraulic tube-switch actuating elements are effectively retained at end-stop positions under the effect of the pressure produced by the reversing pump, until a reversing operation is initiated upon completion of the compression stroke, when the direction of delivery of the reversing pump is retained.

According to a further advantageous refinement of the method according to the invention, when the tube-switch reversing operation is initiated, the output volume and/or the feed pressure of the reversing pump is altered while the direction of delivery is retained. In particular, when the reversing operation is initiated, the reversing pump can be tripped by force for a short time to a maximum output volume and be subsequently readjusted according to its defined output volume or feed pressure.

In cases where greater demands are placed on the output volume, the free-flow circuit arrangement according to the invention enables at least one additional reversing pump to be switched in a parallel connection into the main circuit, without necessitating any additional measures, particularly without having to exchange other valves and fittings.

A device for implementing the method according to the invention advantageously features a controlling and regulating mechanism for adjusting the direction of delivery and possibly the output volume of the reversing pump. This mechanism is able to receive hydraulic or electric end-position signals which are adapted to be tapped off at the tube switch or at its hydraulic actuating elements. The hydraulic tube-switch actuating elements are able to be charged thereby with the pressurized oil tapped off from the main circuit, which leads from the reversing pump to the driving cylinders and is free of valves and fittings. In addition, to enable a return delivery of material from the delivery pipe via the tube switch back into the feed cylinder and from the other feed cylinder into the material feed tank, an inversion element, which responds to a return-delivery signal and which reverses the direction of delivery of the reversing pump, is configured in the circuit arrangement which transmits the hydraulic and electric end-position signals.

Furthermore, a diverter valve, which reverses the direction of the pressurized oil supply, is effectively configured in the hydraulic line which branches off from the main circuit and leads to the hydraulic tube-switch actuating elements. This diverter valve can be actuated by means of a precontrol signal which responds to the direction of delivery of the reversing pump. In the pilot lines leading to the diverter valve, one can configure an additional diverter valve, which is operable by end-position signals from the feed cylinder or from its driving cylinders and can be switched over upon completion of a compression stroke. It initiates the tube-switch reversing operation.

BRIEF DESCRIPTION OF THE DRAWINGS

The invention shall be clarified in greater detail in the following based on an exemplified embodiment schematically depicted in the drawing.

DETAILED DESCRIPTION

Figure 1:
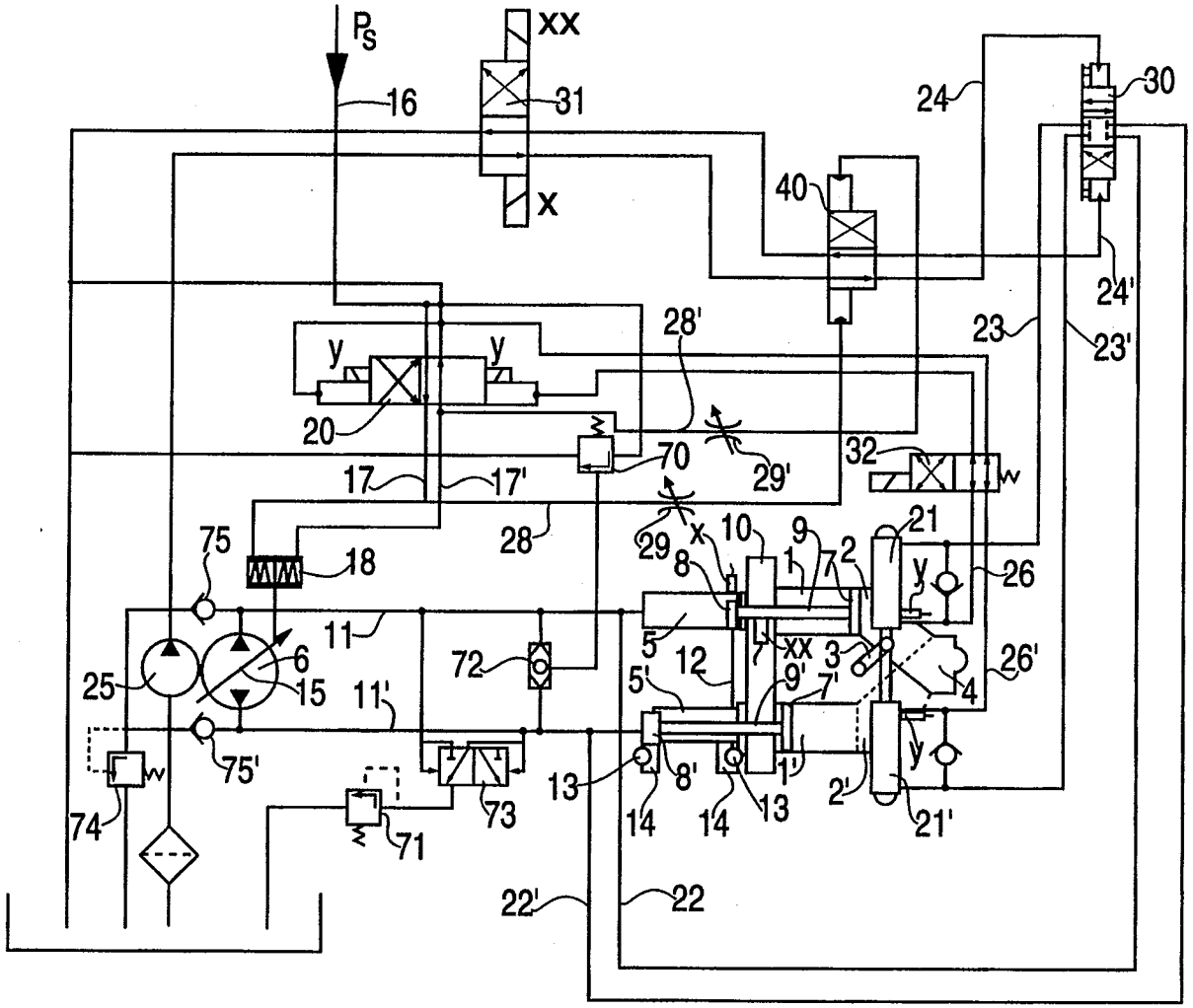
FIGS. 1 shows the circuit of a control-system arrangement for a free-flow sequencing control of driving cylinders and tube-switch cylinders in a one-way flow configuration.

The thick matter pump essentially consists of two feed cylinders 1,1', whose front-side openings 2,2' open through into a material feed tank, which is not shown, and can be alternately connected during the compression stroke by means of a tube switch 3 to a delivery pipe 4. The feed cylinders 1,1' are operated in a push-pull manner by means of hydraulic driving cylinders 5,5' and by means of the reversing hydraulic pump 6 designed in the illustrated exemplified embodiment as a swash-plate axial piston pump. For this purpose, the delivery pistons 7,7' are connected to the pistons 8,8' of the driving cylinders 5,5' by way of a mutual piston rod 9,9'. A water box 10, which is penetrated by the piston rods 9,9', is situated between the feed cylinders 1,1' and the driving cylinders 5,5'.

In the depicted exemplified embodiment, the driving cylinders 5,5' are charged at the head end with pressurized oil via the pressure-media lines 11,11' of the main circuit with the help of the reversing pump 6 and are connected hydraulically to one another at their rod ends via a cross line 12. For purposes of stroke correction, a pressure-compensation line 14, which contains a back-pressure valve 13 and which bridges over the driving piston 8' in question in its end positions, is configured at each of the two ends of the driving cylinder 5'.

The moving direction of the driving pistons 8,8' and thus of the delivery pistons 7,7' is thereby reversed when the swash plate 15 of the reversing pump 6, which is released by a reversing signal, swings through the neutral position and consequently, in the free flow, changes the direction of delivery of the pressurized oil in the lines 11,11' of the main circuit. At a specified driving speed, the output volume of the reversing pump 6 is determined by the swing angle of the swash plate 15. The swash-plate angle and thus the output volume can be adjusted in proportion to a control pressure $P_S$, which actuates the slave cylinder 18 by means of the lines 16, 17 and 17' and by means of the reversing valve 20 situated in each respective line's path. The control pressure $P_S$ can be varied according to the circuit control states of the thick matter pump with hydraulic or electrical means, which are not shown. To adjust the high-pressure and low-pressure levels in the main circuit, pressure regulators 70 and 71 are provided, whose control inputs are suitable for connection via a selector valve 72 or a diverter valve 73 to the lines 11, 11' of the main circuit which convey the high pressure and low pressure, respectively.

The tube switch 3 is switched over by means of the hydraulic cylinders 21, 21' preferably designed as plunger cylinders. The hydraulic cylinders 21, 21' are charged directly with the pressurized oil delivered by the reversing pump 6 via the lines 22, 22', which branch off from the main circuit, via the reversing valve 30, and the pressure-media lines 23, 23'. In the case of the depicted exemplified embodiment, the pilot control of the reversing valve 30 takes place hydraulically via the lines 24, 24', which are able to be charged via the diverter valves 31 and 40 with the control pressure of an auxiliary pump 25, which is operated jointly with the reversing pump 6. The diverter valve 31 can thereby be actuated by means of the electrically or possibly also hydraulically tapped-off, end-position signals x or xx of the driving cylinder 5, while the diverter valve 40 is reversible by means of the lines 28, 28' according to the pressure prevailing in the control lines 17, 17' leading to the slave cylinder 18. The main control valve 20, which determines the direction of delivery of the reversing pump 6, is actuated by end-position signals from the tube-switch cylinders 21,21', which are adapted to be tapped off via the hydraulic lines 26, 26' and/or via electrical sensing elements y.

The auxiliary pump 25 also charges the closed main circuit via the back-pressure valves 75, 75' and is safeguarded by the relief valve 74.

The depicted circuit arrangement provides for a sequencing control of the driving cylinders 5, 5' and of the tube-switch cylinders 21, 21', which functions as follows:

When in the course of a delivery operation, for example, the rod-end position of the driving piston 8 is reached in the driving cylinder 5, a reversal of the diverter valve 31 is initiated by means of the electrically tapped-off end-position signal x. In this manner, the reversing valve 30 is reversed while initiating a reversing operation at the tube-switch cylinders 21,21', whereby the direction of delivery of the reversing pump 6 is initially still retained and the driving pistons 8,8' are each kept in their respective end position by means of the pressurized oil in the line 11. When the tube switch 3 reaches its end position, the valve 20 is reversed by means of the corresponding end-position signal. In this manner, the pilot control changes at the slave cylinder 18, so that the swash plate 15 of the reversing pump 6 swings through while reversing the direction of delivery. Parallel to this, the reversing signal is tapped off between the valve 20 and the slave cylinder 18 and fed via the lines 28,28' to the pilot control of the valve 40. The valve 40 consequently changes its position and thus assures that the tube-switch cylinders 21,21' retain the previously occupied end positions in spite of the reversal in the direction of delivery of the reversing pump 6. Since the pilot valve 40 reacts to the reversing signal faster than the reversing pump 6 does, adjustable restrictors 29, 29' are mounted in the pilot lines 28, 28' in order to effect a slow through-connection of the pilot valve 40 and thus of the diverter valve 30, in a manner which is adapted to the time response of the reversing pump 6. This prevents the tube-switch cylinders 21, 21' from switching back during the time that the direction of delivery is being reversed, as this would not be desirable. If necessary, the driving cylinders 5, 5' can be pressurized in an opposite manner by means of the return-feed valve 32, which is arranged upstream from the reversing valve 20 in the control lines 26, 26', so that material is fed back from the delivery pipe into the supply tank.

The described one-way flow configuration is primarily suited for smaller or low-speed installations, where it is critical to have the smallest possible number of hydraulic units. A two-way flow, sequential circuit would provide a solution for large, high-speed machines, where the tube switch reversing valve 30 is not connected via the lines 22, 22' to the main circuit, but rather to a separate hydraulic circuit. In the latter case, the diverter valve 40 can be eliminated.

Figure 2:
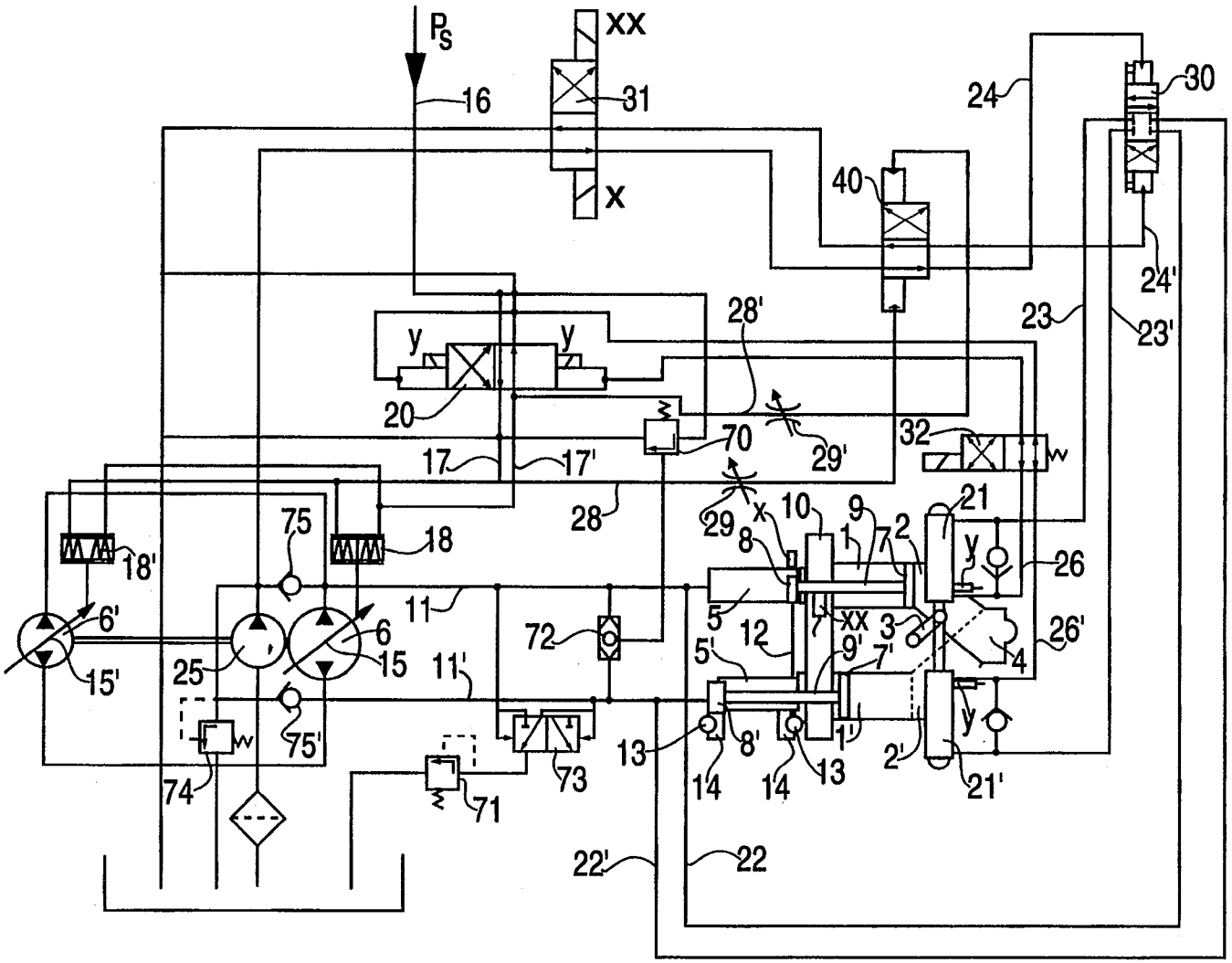
FIG. 2 shows a circuit of a control system arrangement similar to that of FIG. 1, but with an additional reversing pump.

The embodiment shown on FIG. 2 differs from that of FIG. 1 in that a second reversing pump 6' is added in parallel to the main circuit 11, 11'. The deliver amount of the reversing pump 6' is determined with a preset drive number by the angle of traverse of a tilting disk 15' which is adjustable via a setting cylinder 18'. By reason of the addition of a further reversing pump the delivery amount in the main circuit may be doubled if required. As the main circuit 11, 11' is free of valves and fittings, no additional adaptation is necessary.

I claim:

1. A method for controlling a thick matter pump including two feed cylinders, each coupled in fluid communication with a material feed tank and including a drive piston for pumping thick matter through the respective feed cylinder, each drive piston being driven within a respective drive cylinder which are each in turn coupled to a hydraulic reversing pump, the reversing pump driving a respective drive piston through a compression stroke by pumping pressurized fluid to the respective drive cylinder, a hydraulically operable tube switch adapted to be alternately coupled to the feed cylinders to receive the thick matter being pumped from the respective feed cylinder to which it is coupled, and being coupled to a delivery pipe to direct the flow of thick matter from each feed cylinder into the delivery pipe, comprising the following steps:

actuating the tube switch to be decoupled from one feed cylinder and coupled to the other upon the drive piston of the respective feed cylinder coupled to the tube switch reaching the end of its compression stroke, and upon actuating the tube switch, maintaining the direction of pressurized fluid flow from the reversing pump to maintain the respective drive piston at the end of its compression stroke, thus interrupting the flow of thick matter from the feed cylinders, and then reversing the direction of fluid flow through the reversing pump upon the tube switch being coupled to the other feed cylinder to initiate the compression stroke of the other feed cylinder, wherein the hydraulically operable tube switch is actuated by directing pressurized fluid to the tube switch from a circuit connecting the reversing pump and a drive cylinder, the circuit being free of valves therein.

2. A method a defined in claim 1, further comprising the step of transmitting an electric signal upon the tube switch being coupled to the other feed cylinder for initiating a reversal of the reversing pump.

3. A method a defined in claim 1, further comprising the step of reversing the flow of pressurized fluid to the tube switch upon reversing the direction of fluid flow through the reversing pump.

4. A method a defined in claim 1, further comprising the step of maintaining the supply of pressurized fluid from the reversing pump to the tube switch to maintain the coupling between the tube switch and a respective feed cylinder while pumping thick matter from the respective feed cylinder through the tube switch, until actuating the tube switch upon the respective drive piston reaching the end of its compression stroke.

5. A method a defined in claim 1, further comprising the step of transmitting a hydraulic signal upon the tube switch being coupled to the other feed cylinder for initiating a reversal of the reversing pump.

6. A method a defined in claim 1, further comprising the step of interrupting the flow of pressurized fluid to the tube switch upon reversing the direction of fluid flow through the reversing pump.

7. A device for controlling a thick matter pump having two feed cylinders, each coupled in fluid communication with a material feed tank and including a drive piston for pumping thick matter through the respective feed cylinder, each drive piston being driven within a respective drive cylinder which are each in turn coupled in a circuit to a hydraulic reversing pump, the reversing pump driving a respective drive piston through a compression stroke by pumping pressurized fluid to the respective drive cylinder, a hydraulically operable tube switch adapted to be alternately coupled to the feed cylinders to receive the thick matter being pumped from the respective feed cylinder to which it is coupled, and being coupled to a delivery pipe to direct the flow of thick matter from each feed cylinder into the delivery pipe, the device comprising:

first means for actuating the tube switch and coupled between the reversing pump and the drive cylinders for receiving pressurized fluid flowing between the reversing pump and the drive cylinders to drive the tube switch and, thus, decouple the tube switch from one feed cylinder and coupled the tube switch to the other, wherein there are no valves in the circuit connecting the reversing pump and the drive cylinders, wherein the first means actuates the tube switch upon the drive piston of the respective feed cylinder coupled to the tube switch reaching the end of its compression stroke, and upon actuating the tube switch, the direction of pressurized fluid flow from the reversing pump is maintained to maintain the respective drive piston at the end of its compression stroke, and then the direction of fluid flow through the tube switch is reversed upon the tube switch being coupled to the other feed cylinder to initiate the compression stroke of the other feed cylinder.

8. A device as defined in claim 7, wherein the reversing pump is adjustable to achieve a predetermined output volume and/or feed pressure during either the pumping of thick matter through the feed cylinders or actuation of the tube switch.

9. A device as defined in claim 7, further comprising:

second means for transmitting an output signal upon the tube switch being coupled to a respective feed cylinder; and a control mechanism coupled between the reversing pump and the second means for controlling the direction of delivery of the reversing pump in response to the signals transmitted by the second means.

10. A device as defined in claim 9, wherein the control mechanism includes a first diverter valve for receiving the signals transmitted by the second means and adjusting the direction of delivery of the reversing pump in response.

11. A device as defined in claim 7, further comprising:

a diverter valve coupled between the reversing pump and the drive cylinders and the first means for reversing the direction of pressurized fluid flowing to the first means; and a pilot valve coupled between the diverter valve and the reversing pump for controlling the diverter valve in response to the direction of delivery of the reversing pump.

12. A device as defined in claim 11, wherein the control signal transmitted by the pilot valve to the diverter valve is delayed to compensate for a delayed response of the reversing pump to a signal initiating a reversal of the direction of delivery of the reversing pump.

13. A method for controlling a thick matter pump including two feed cylinders, each coupled in fluid communication with a material feed tank and including a drive piston for pumping thick matter through the respective feed cylinder, each drive piston being driven within a respective drive cylinder which are each in turn coupled to a hydraulic reversing pump, the reversing pump driving a respective drive piston through a compression stroke by pumping pressurized fluid to the respective drive cylinder, a hydraulically operable tube switch adapted to be alternately coupled to the feed cylinders to receive the thick matter being pumped from the respective feed cylinder to which it is coupled, and being coupled to a delivery pipe to direct the flow of thick matter from each feed cylinder into the delivery pipe, comprising the following steps:

actuating the tube switch to be decoupled from one feed cylinder and coupled to the other upon the drive piston of the respective feed cylinder coupled to the tube switch reaching the end of its compression stroke, and upon actuating the tube switch, maintaining the direction of pressurized fluid flow from the reversing pump to maintain the respective drive piston at the end of its compression stroke, thus interrupting the flow of thick matter from the feed cylinders, and then reversing the direction of fluid flow through the reversing pump upon the tube switch being coupled to the other feed cylinder to initiate the compression stroke of the other feed cylinder, wherein the hydraulically operable tube switch is actuated by directing pressurized fluid flowing between the reversing pump and a drive cylinder to the tube switch, and further comprising the step of altering the output volume and/or feed pressure of the reversing pump while maintaining the direction of pressurized fluid flow from the reversing pump upon actuating the tube switch.

14. A method for controlling a thick matter pump including two feed cylinders, each coupled in fluid communication with a material feed tank and including a drive piston for pumping thick matter through the respective feed cylinder, each drive piston being driven within a respective drive cylinder which are each in turn coupled to a hydraulic reversing pump, the reversing pump driving a respective drive piston through a compression stroke by pumping pressurized fluid to the respective drive cylinder, a hydraulically operable tube switch adapted to be alternately coupled to the feed cylinders to receive the thick matter being pumped from the respective feed cylinder to which it is coupled, and being coupled to a delivery pipe to direct the flow of thick matter from each feed cylinder into the delivery pipe, comprising the following steps:

actuating the tube switch to be decoupled from one feed cylinder and coupled to the other upon the drive piston of the respective feed cylinder coupled to the tube switch reaching the end of its compression stroke, and upon actuating the tube switch, maintaining the direction of pressurized fluid flow from the reversing pump to maintain the respective drive piston at the end of its compression stroke, thus interrupting the flow of thick matter from the feed cylinders, and then reversing the direction of fluid flow through the reversing pump upon the tube switch being coupled to the other feed cylinder to initiate the compression stroke of the other feed cylinder, wherein the hydraulically operable tube switch is actuated by directing pressurized fluid flowing between the reversing pump and a drive cylinder to the tube switch, and further comprising the step of temporarily increasing the output volume of the reversing pump upon actuating the tube switch.

15. A method for controlling a thick matter pump including two feed cylinders, each coupled in fluid communication with a material feed tank and including a drive piston for pumping thick matter through the respective feed cylinder, each drive piston being driven within a respective drive cylinder which are each in turn coupled to a hydraulic reversing pump, the reversing pump driving a respective drive piston through a compression stroke by pumping pressurized fluid to the respective drive cylinder, a hydraulically operable tube switch adapted to be alternately coupled to the feed cylinders to receive the thick matter being pumped from the respective feed cylinder to which it is coupled, and being coupled to a delivery pipe to direct the flow of thick matter from each feed cylinder into the delivery pipe, comprising the following steps:

actuating the tube switch to be decoupled from one feed cylinder and coupled to the other upon the drive piston of the respective feed cylinder coupled to the tube switch reaching the end of its compression stroke, and upon actuating the tube switch, maintaining the direction of pressurized fluid flow from the reversing pump to maintain the respective drive piston at the end of its compression stroke, thus interrupting the flow of thick matter from the feed cylinders, and then reversing the direction of fluid flow through the reversing pump upon the tube switch being coupled to the other feed cylinder to initiate the compression stroke of the other feed cylinder, wherein the hydraulically operable tube switch is actuated by directing pressurized fluid flowing between the reversing pump and a drive cylinder to the tube switch, wherein at least one additional reversing pump is coupled to the drive cylinders.

16. A device for controlling a thick matter pump having two feed cylinders, each coupled in fluid communication with a material feed tank and including a drive piston for pumping thick matter through the respective feed cylinder, each drive piston being driven within a respective drive cylinder which are each in turn coupled to a hydraulic reversing pump, the reversing pump driving a respective drive piston through a compression stroke by pumping pressurized fluid to the respective drive cylinder, a hydraulically operable tube switch adapted to be alternately coupled to the feed cylinders to receive the thick matter being pumped from the respective feed cylinder to which it is coupled, and being coupled to a delivery pipe to direct the flow of thick matter from each feed cylinder into the delivery pipe, the device comprising:

first means for actuating the tube switch and coupled between the reversing pump and the drive cylinders for receiving pressurized fluid flowing between the reversing pump and the drive cylinders to drive the tube switch and, thus, decouple the tube switch to the other, wherein the first means actuates the tube switch upon the drive piston of the respective feed cylinder coupled to the tube switch reaching the end of its compression stroke, and upon actuating the tube switch, the direction of pressurized fluid flow from the reversing pump is maintained to maintain the respective drive piston at the end of its compression stroke, and then the direction of fluid flow through the tube switch is reversed upon the tube switch being coupled to the other feed cylinder to initiate the compression stroke of the other feed cylinder, wherein the reversing pump is adjustable to achieve a predetermined output volume and/or feed pressure during either the pumping of thick matter through the feed cylinders or actuation of the tube switch.

17. A device for controlling a thick matter pump having two feed cylinders, each coupled in fluid communication with a material feed tank and including a drive piston for pumping thick matter through the respective feed cylinder, each drive piston being driven within a respective drive cylinder which are each in turn coupled to a hydraulic reversing pump, the reversing pump driving a respective drive piston through a compression stroke by pumping pressurized fluid to the respective drive cylinder, a hydraulically operable tube switch adapted to be alternately coupled to the feed cylinders to receive the thick matter being pumped from the respective feed cylinder to which it is coupled, and being coupled to a delivery pipe to direct the flow of thick matter from each feed cylinder into the delivery pipe, the device comprising:

first means for actuating the tube switch and coupled between the reversing pump and the drive cylinders for receiving pressurized fluid flowing between the reversing pump and the drive cylinders to drive the tube switch and, thus, decouple the tube switch from one feed cylinder and couple the tube switch to the other, wherein the first means actuates the tube switch upon the drive piston of the respective feed cylinder coupled to the tube switch reaching the end of its compression stroke, and upon actuating the tube switch, the direction of pressurized fluid flow from the reversing pump is maintained to maintain the respective drive piston at the end of its compression stroke, and then the direction of fluid flow through the tube switch is reversed upon the tube switch being coupled to the other feed cylinder to initiate the compression stroke of the other feed cylinder;

second means for transmitting an output signal upon the tube switch being coupled to a respective feed cylinder;

a control mechanism coupled between the reversing pump and the second means for controlling the direction of delivery of the reversing pump in response to the signals transmitted by the second means, wherein the control mechanism includes a first diverter value for receiving the signals transmitted by the second means and adjusting the direction of delivery of the reversing pump in response; and a return-feed valve coupled between the first diverter valve and the second means and responsive to the signals transmitted by the second delivery means for reversing the direction of delivery of the reversing pump.

18. A device for controlling a thick matter pump having two feed cylinders, each coupled in fluid communication with a material feed tank and including a drive piston for pumping thick matter through the respective feed cylinder, each drive piston being driven within a respective drive cylinder which are each in turn coupled to a hydraulic reversing pump, the reversing pump driving a respective drive piston through a compression stroke by pumping pressurized fluid to the respective drive cylinder, a hydraulically operable tube switch adapted to be alternately coupled to the feed cylinders to receive the thick matter being pumped from the respective feed cylinder to which it is coupled, and being coupled to a delivery pipe to direct the flow of thick matter from each feed cylinder into the delivery pipe, the device comprising:

first means for actuating the tube switch and coupled between the reversing pump and the drive cylinders for receiving pressurized fluid flowing between the reversing pump and the drive cylinders to drive the tube switch and, thus, decouple the tube switch from one feed cylinder and couple the tube switch to the other, wherein the first means actuates the tube switch upon the drive piston of the respective feed cylinder coupled to the tube switch reaching the end of its compression stroke, and upon actuating the tube switch, the direction of pressurized fluid flow from the reversing pump is maintained to maintain the respective drive piston at the end of its compression stroke, and then the direction of fluid flow through the tube switch is reversed upon the tube switch being coupled to the other feed cylinder to initiate the compression stroke of the other feed cylinder;

a diverter valve coupled between the reversing pump and the drive cylinders and the first means for reversing the direction of pressurized fluid flowing to the first means;

a pilot valve coupled between the diverter valve and the reversing pump for controlling the diverter valve in response to the direction of delivery of the reversing pump;

means for transmitting an output signal upon either drive piston reaching the end of its compression stroke; and a second diverter valve coupled between the pilot valve and an auxiliary pump for directing the flow of pressurized fluid from the auxiliary pump to the pilot valve to actuate the pilot valve, and coupled to the means for transmitting an output signal for actuating the pilot valve in response to the output signals transmitted by the said means.

19. A device as defined in claim 18, further comprising:

means coupled to the means for transmitting an output signal and the reversing pump for controlling the output volume and/or the feed pressure of the reversing pump in response to the signals transmitted by the means for transmitting an output signal.

20. A method for controlling a thick matter pump including two feed cylinders, each coupled in fluid communication with a material feed tank and including a drive piston for pumping thick matter through the respective feed cylinder, each drive piston being driven within a respective drive cylinder which are each in turn coupled to a hydraulic reversing pump, the reversing pump driving a respective drive piston through a compression stroke by pumping pressurized fluid to the respective drive cylinder, a hydraulically operable tube switch adapted to be alternately coupled to the feed cylinders to receive the thick matter being pumped from the respective feed cylinder to which it is coupled, and being coupled to a delivery pipe to direct the flow of thick matter from each feed cylinder into the delivery pipe, comprising the following steps:

actuating the tube switch to be decoupled from one feed cylinder and coupled to the other upon the drive piston of the respective feed cylinder coupled to the tube switch reaching the end of its compression stroke, and upon actuating the tube switch, maintaining the direction of pressurized fluid flow from the reversing pump to maintain the respective drive piston at the end of its compression stroke, thus interrupting the flow of thick matter from the feed cylinders, and then reversing the direction of fluid flow through the reversing pump upon the tube switch being coupled to the other feed cylinder to initiate the compression stroke of the other feed cylinder, wherein the hydraulically operable tube switch is actuated by directing pressurized fluid to the tube switch from a circuit connecting the reversing pump and a drive cylinder, the circuit being free of valves therein, and further comprising the step of altering the output volume and/or feed pressure of the reversing pump while maintaining the direction of pressurized fluid flow from the reversing pump upon actuating the tube switch.

21. A method for controlling a thick matter pump including two feed cylinders, each coupled in fluid communication with a material feed tank and including a drive piston for pumping thick matter through the respective feed cylinder, each drive piston being driven within a respective drive cylinder which are each in turn coupled to a hydraulic reversing pump, the reversing pump driving a respective drive piston through a compression stroke by pumping pressurized fluid to the respective drive cylinder, a hydraulically operable tube switch adapted to be alternately coupled to the feed cylinders to receive the thick matter being pumped from the respective feed cylinder to which it is coupled, and being coupled to a delivery pipe to direct the flow of thick matter from each feed cylinder into the delivery pipe, comprising the following steps:

actuating the tube switch to be decoupled from one feed cylinder and coupled to the other upon the drive piston of the respective feed cylinder coupled to the tube switch reaching the end of its compression stroke, and upon actuating the tube switch, maintaining the direction of pressurized fluid flow from the reversing pump to maintain the respective drive piston at the end of its compression stroke, thus interrupting the flow of thick matter from the feed cylinders, and then reversing the direction of fluid flow through the reversing pump upon the tube switch being coupled to the other feed cylinder to initiate the compression stroke of the other feed cylinder, wherein the hydraulically operable tube switch is actuated by directing pressurized fluid to the tube switch from a circuit connecting the reversing pump and a drive cylinder, the circuit being free of valves therein, and further comprising the step of temporarily increasing the output volume of the reversing pump upon actuating the tube switch.

22. A method for controlling a thick matter pump including two feed cylinders, each coupled in fluid communication with a material feed tank and including a drive piston for pumping thick matter through the respective feed cylinder, each drive piston being driven within a respective drive cylinder which are each in turn coupled to a hydraulic reversing pump, the reversing pump driving a respective drive piston through a compression stroke by pumping pressurized fluid to the respective drive cylinder, a hydraulically operable tube switch adapted to be alternately coupled to the feed cylinders to receive the thick matter being pumped from the respective feed cylinder to which it is coupled, and being coupled to a delivery pipe to direct the flow of thick matter from each feed cylinder into the delivery pipe, comprising the following steps:

actuating the tube switch to be decoupled from one feed cylinder and coupled to the other upon the drive piston of the respective feed cylinder coupled to the tube switch reaching the end of its compression stroke, and upon actuating the tube switch, maintaining the direction of pressurized fluid flow from the reversing pump to maintain the respective drive piston at the end of its compression stroke, thus interrupting the flow of thick matter from the feed cylinders, and then reversing the direction of fluid flow through the reversing pump upon the tube switch being coupled to the other feed cylinder to initiate the compression stroke of the other feed cylinder, wherein the hydraulically operable tube switch is actuated by directing pressurized fluid to the tube switch from a circuit connecting the reversing pump and a drive cylinder, the circuit being free of valves therein, wherein at least one additional reversing pump is coupled to the drive cylinders.

23. A device for controlling a thick matter pump having two feed cylinders, each coupled in fluid communication with a material feed tank and including a drive piston for pumping thick matter through the respective feed cylinder, each drive piston being driven within a respective drive cylinder which are each in turn coupled to a hydraulic reversing pump, the reversing pump, the reversing pump driving a respective drive piston through a compression stroke by pumping pressurized fluid to the respective drive cylinder, a hydraulically operable tube switch adapted to be alternately coupled to the feed cylinders to receive the thick matter being pumped from the respective feed cylinder to which it is coupled, and being coupled to a delivery pipe to direct the flow of thick matter from each feed cylinder into the delivery pipe, the device comprising:

first means for actuating the tube switch and coupled between the reversing pump and the drive cylinders for receiving pressurized fluid flowing between the reversing pump and the drive cylinders to drive the tube switch and, thus, decouple the tube switch from one feed cylinder and couple the tube switch to the other, wherein there are no valves in the circuit connecting the reversing pump and the drive cylinders, wherein the first means actuates the tube switch upon the drive piston of the respective feed cylinder coupled to the tube switch reaching the end of its compression stroke, and upon actuating the tube switch, the direction of pressurized fluid flow from the reversing pump is maintained to maintain the respective drive piston at the end of its compression stroke, and then the direction of fluid flow through the tube switch is reversed upon the tube switch being coupled to the other feed cylinder to initiate the compression stroke of the other feed cylinder;

second means for transmitting an output signal upon the tube switch being coupled to a respective feed cylinder;

a control mechanism coupled between the reversing pump and the second means for controlling the direction of delivery of the reversing pump in response to the signals transmitted by the second means, wherein the control mechanism includes a first diverter valve for receiving the signals transmitted by the second means and adjusting the direction of delivery of the reversing pump in response; and a return-feed valve and the second means and responsive to the signals transmitted by the second means for reversing the direction of delivery of the reversing pump.

24. A device for controlling a thick matter pump having two feed cylinders, each coupled in fluid communication with a material feed tank and including a drive piston for pumping thick matter through the respective feed cylinder, each drive piston being driven within a respective drive cylinder which are each in turn coupled to a hydraulic reversing pump, the reversing pump, the reversing pump driving a respective drive piston through a compression stroke by pumping pressurized fluid to the respective drive cylinder, a hydraulically operable tube switch adapted to be alternately coupled to the feed cylinders to receive the thick matter being pumped from the respective feed cylinder to which it is coupled, and being coupled to a delivery pipe to direct the flow of thick matter from each feed cylinder into the delivery pipe, the device comprising:

first means for actuating the tube switch and coupled between the reversing pump and the drive cylinders for receiving pressurized fluid flowing between the reversing pump and the drive cylinders to drive the tube switch and, thus, decouple the tube switch from one feed cylinder and couple the tube switch to the other, wherein there are no valves in the circuit connecting the reversing pump and the drive cylinders, wherein the first means actuates the tube switch upon the drive piston of the respective feed cylinder coupled to the tube switch reaching the end of its compression stroke, and upon actuating the tube switch, the direction of pressurized fluid flow from the reversing pump is maintained to maintain the respective drive piston at the end of its compression stroke, and then the direction of fluid flow through the tube switch is reversed upon the tube switch being coupled to the other feed cylinder to initiate the compression stroke of the other feed cylinder;

a diverter valve coupled between the reversing pump and the drive cylinders and the first means for reversing the direction of pressurized fluid flowing to the first means;

a pilot valve coupled between the diverter valve and the reversing pump for controlling the diverter valve in response to the direction of delivery of the reversing pump;

means for transmitting an output signal upon either drive piston reaching the end of its compression stroke; and a second diverter valve coupled between the pilot valve and an auxiliary pump for directing the flow of pressurized fluid from the auxiliary pump to the pilot valve to actuate the pilot valve, and coupled to the means for transmitting an output signal for actuating the pilot valve in response to the output signals transmitted by the said means.

25. A device as defined in claim 24, further comprising:

means coupled to the means for transmitting an output signal and the reversing pump for controlling the output volume and/or the feed pressure of the reversing pump in response to the signals transmitted by the means for transmitting an output signal.

* * * * *

UNITED STATES PATENT AND TRADEMARK OFFICE

CERTIFICATE OF CORRECTION

PATENT NO. : 5,344,290

DATED : SEPT. 6, 1994

INVENTOR(S) : BENCKERT,H.

It is certified that error appears in the above-identified patent and that said Letters Patent is hereby corrected as shown below:

In column 3, line 37, change "FIGS" to --FIG--;

Column 6, line 59, change "coupled" to --couple--;

Column 9, line 33, change "switch to" to --switch from one feed cylinder and couple the tube switch to--;

Column 10, line 24, change "value" to --valve--;

Column 13, line 5 and column 14, line 1, change "coupled" to --coupled in a circuit--;

Column 13, line 6 and column 14, line 2, change "pump, the reversing pump driving" to --pump driving--;

Column 13, line 47, change "valve and" to --valve coupled between the first diverter valve and--.

Signed and Sealed this

Ninth Day of May, 1995

Bruce Lehman

*Attest:*

BRUCE LEHMAN

*Attesting Officer*

*Commissioner of Patents and Trademarks*